US009435130B2

(12) United States Patent
Briganti

(10) Patent No.: US 9,435,130 B2
(45) Date of Patent: Sep. 6, 2016

(54) LAYOUT TOOL

(71) Applicant: Joseph Briganti, Randolph, NJ (US)

(72) Inventor: Joseph Briganti, Randolph, NJ (US)

(73) Assignee: JB Builders LLC, Randolph, NJ (US)

( * ) Notice: Subject to any disclaimer, the term of this patent is extended or adjusted under 35 U.S.C. 154(b) by 98 days.

(21) Appl. No.: 14/593,673

(22) Filed: Jan. 9, 2015

(65) Prior Publication Data

US 2016/0201344 A1 Jul. 14, 2016

(51) Int. Cl.
*B43L 7/027* (2006.01)
*E04G 21/18* (2006.01)

(52) U.S. Cl.
CPC ..... *E04G 21/1891* (2013.01)

(58) Field of Classification Search
CPC ..... B43L 7/02; E04G 21/1891
USPC ..... 33/429, 474, 479, 481, 562, 563, 566
See application file for complete search history.

(56) References Cited

U.S. PATENT DOCUMENTS 2,659,980 A * 11/1953 Dunn ..... B25H 7/02 33/489
3,201,874 A 8/1965 Christy
4,361,964 A 12/1982 Hennessee
4,499,666 A 2/1985 Smith
4,527,337 A 7/1985 Dreiling
4,607,438 A 8/1986 Defrange
5,129,153 A * 7/1992 Burns, Sr. ..... E04G 21/1891 33/501.45
5,367,783 A 11/1994 Nygren
5,396,710 A 3/1995 Bataglia
5,456,015 A 10/1995 Butcher et al.
5,960,554 A 10/1999 Kamykowski
6,049,990 A * 4/2000 Holland ..... B43L 7/02 33/464
6,272,758 B1 * 8/2001 Wheeler ..... B43L 7/027 33/1 G
6,293,028 B1 9/2001 Sylvia
6,775,916 B2 8/2004 Sparkes
6,895,683 B1 5/2005 Olsen
6,935,039 B1 * 8/2005 Hess ..... D05B 7/12 33/1 B
7,269,909 B1 * 9/2007 Barbieri ..... B43L 7/12 33/419
7,546,691 B2 6/2009 Mackey
7,644,510 B2 1/2010 Gingerella et al.
8,028,434 B2 10/2011 McHowell
8,448,348 B1 * 5/2013 Jones ..... E04G 21/1891 33/613
2001/0013178 A1 8/2001 Lafrance
2002/0100174 A1 * 8/2002 Gooden ..... B25H 1/0078 33/42
2003/0051359 A1 3/2003 Connor
2004/0074101 A1 4/2004 Dillard
2006/0156558 A1 7/2006 Owens
2006/0174500 A1 8/2006 Knirck
2006/0277779 A1 * 12/2006 Bauer ..... B25H 7/02 33/566
2008/0155849 A1 * 7/2008 Bagley ..... D05B 7/12 33/566
2009/0094850 A1 * 4/2009 Cannon ..... G01B 5/02 33/562
2013/0139398 A1 6/2013 Bierman
2013/0219732 A1 8/2013 Jordan
2015/0343628 A1 * 12/2015 Moreland ..... B25H 7/005 33/562

* cited by examiner

*Primary Examiner* — G. Bradley Bennett
(74) *Attorney, Agent, or Firm* — Gearhart Law, LLC

(57) ABSTRACT

A layout tool may have a length and several marking areas or sections by which the headers, footers, and studs of a wall can be marked and subsequently assembled. The layout tool has a bend at about a right angle along the length of the layout tool allowing it to lay over multiple pieces of building material at once. Once marked, the building materials can be assembled quickly and with limited or no human error.

17 Claims, 4 Drawing Sheets

LAYOUT TOOL

CLAIM OF PRIORITY

This application is a non-provisional application and claims no priority to any patent or patent application.

FIELD OF THE EMBODIMENTS

The field of the invention and it embodiments relate to layout tools for determining various measurements used in carpentry and general construction, namely building framing. In particular, the present invention and its embodiments relate to a framing tool to be used for the simultaneously marking headers and footers for proper alignment with studs of the frame.

BACKGROUND OF THE EMBODIMENTS

When a building or structure is being built during construction, one of the most fundamentally important steps is the prepping and constructing of the layout of the structure. This process is commonly referred to as framing. Typically all interior and exterior walls are framed with at least one horizontal header and one horizontal footer with a plurality of vertically situated studs spaced therebetween. The wall material, typically drywall or gypsum is placed on interior framed walls, whereas siding and roofing of various materials are placed on the exterior walls.

In framing a structure, both wood and metal studs can be used, however, in most residential buildings, wood is the most frequently used framing material. The framing materials are typically 2×4 and 2×6 pieces of lumber. As opposed to their common naming, the actual dimensions of such pieces of lumber are 1.5×3.5 inches and 1.5×5.5 inches respectively. Such dimensions must be taken into account when framing a structure as to provide proper spacing between studs and at the correct point along the footers and headers.

A carpenter, or other worker, will mark the pieces of wood to be used in the framing for the structure. These marks are usually positioned with the guidance from a measuring tape and a general standard placement of the studs on 16" centers and in rarer occasions 24" centers. The framing is then typically assembled on the ground and lifted into position or alternatively positioning the headers and footers and then placing the studs therebetween.

Problems with the aforementioned methodology can begin to arise when the wood or lumber is being marked. The measuring tape being used may slip, unbeknownst to the worker, or other human error may both result in improper marking along the wood. Once a mistake happens, it is often only caught late in the process, once the framed wall is at least partially assembled, thereby requiring the work to be redone with the proper measurement and costing the company or other entity time and resources. Additionally, the process can be slow as the headers and footers are often individually marked. In many structures, this requires many calculations and speed efficiency thereby increasing the chance of an error being made.

Thus, there is a need for a process for marking materials used in framing quickly and expeditiously. Further, it is imperative that such a process removes or limits the occurrence of human error associated with slippages or miscalculations. The present invention and its embodiments meet and exceed these objectives.

REVIEW OF RELATED TECHNOLOGY

U.S. Pat. No. 6,895,683 pertains to a carpenter's layout tool that has various measurements thereon, which measurements are used during stud wall construction. The tool has a pair of feet, each with a centrally disposed opening, the feet being joined at a lower surface of each by a connecting bar. The connecting bar has measurements, both left justified and right justified, for joining corner marks, corner marks, and intersecting wall marks, using either 2×4 or 2×6 inch construction. The tool is dimensioned so that the feet provide stud spacing with one of the openings in the respective foot being used for measurement initialization.

U.S. Pat. No. 6,775,916 pertains to a layout tool for laying out or "marking" positions at a predetermined spacing for the attachment of studs having a nominal thickness to a length of dimensioned lumber comprising a plate, when framing walls during construction of a building. The layout tool includes an elongated rail for placement against the plate, and a first stud marking guide extending perpendicularly from the elongated rail. The first stud marking guide has left and right side edges, and width between the side edges corresponding to the nominal thickness of the studs. A separate stud marking guide extends perpendicularly from the elongated rail. The second stud marking guide likewise has left and right side edges and a width between the side edges corresponding to the nominal thickness of the studs. The left edge of the second stud marking guide is spaced from the left edge of the first stud marking guide a distance equal to the predetermined stud spacing. A primary starter marking indication is provided on the elongated rail intermediate the first and second stud marking guides. The primary starter marking indication is spaced from the second stud marking guide a distance equal to one-half the nominal thickness of the studs.

U.S. Pat. No. 5,960,554 pertains to a stud layout template for marking locations for the placement of studs on a floor plate or a ceiling plate using center lines on the respective floor or ceiling plate. The stud layout template includes a plate having a main portion and an end portion outwardly extending from the main portion. The main portion has a cutout therethrough having an outer periphery comprising a pair of ends and a pair of sides extending between the ends of the cutout. The plate has an extent extending into the cutout from a first end of the cutout. The extent of the plate has a pair of side edges converging together to form a pointer vertex positioned substantially equidistantly between the sides of the cutout.

U.S. Patent Application 2006/0174500 pertains to a carpenter's framing square, which utilizes an opening located on the centerline of the blade. This centering window allows the user to place the 1½" wide blade on the centerline of a layout mark in order to strike parallel edge marks to locate a framing stud on the top/bottom plates of a stud wall.

Various devices are known in the art. However, their structure and means of operation are substantially different from the present disclosure. The other inventions fail to solve all the problems taught by the present disclosure. The present invention and its embodiments provide for a tool that quickly and easily enables one to mark positions for studs on the footers and headers used in framing a structure. At least one embodiment of this invention is presented in the drawings below and will be described in more detail herein.

SUMMARY OF THE EMBODIMENTS

The present invention and its embodiments describe and teach a layout tool for measuring and marking a dimensioned length of material, the layout tool having at least two first marking sections, wherein each of the at least two first marking sections has at least one first marking cutout; at least two second marking sections, wherein each of the at least two second marking sections has at least one second marking cutout; a bar body having a first end and a second end which couples the at least two first marking sections and the at least two second marking sections, wherein one of the at least two first marking sections and one of the at least two second marking sections are positioned on the first end, and wherein one of the at least two first marking sections and one of the at least two second marking sections are positioned on the second end of the bar body.

In another embodiment of the present invention there is a layout tool having at least two first marking sections, wherein each of the at least two first marking sections has at least one first marking cutout; at least two second marking sections, wherein each of the at least two second marking sections has at least one second marking cutout; an angled bar body having a first end and a second end which couples the at least two first marking sections and the at least two second marking sections, wherein one of the at least two first marking sections and one of the at least two second marking sections are positioned on the first end, and wherein one of the at least two first marking sections and one of the at least two second marking sections are positioned on the second end of the bar body; and a plurality of markings along a length of the bar body, the plurality of markings being spaced equidistant from one another. In general, the present invention succeeds in conferring the following, and others not mentioned, benefits and objectives.

Generally, the present invention and its embodiments embody a layout tool used to mark pieces of dimensioned lumber for framing a structure during the construction process. The layout tool is about 17.5 inches in length to facilitate the framing process. Marking sections are placed on either end of the length of the layout tool that are 1.5 inches wide. This accommodates and enables one to mark the position of the studs which are typically 1.5 inches by 3.5 inches. Various measurements may be marked in between the first end and the second end of the layout tool.

The main body or bar body of the layout tool is angled allowing it to extend over multiple pieces of dimensioned lumber. The angle formed is approximately 90° thus enabling the layout tool to lie flush with the dimensioned lumber. The bend or angling in the bar body is done down a midline of the length of the bar body. Graduated markings are positioned along each edge of the bar body on each side of the angling or bending.

The layout tool is typically laid over three pieces of dimensioned lumber to be used in framing a structure. Markings are made on each side of each of the markings sections and a mark is made in the middle of these sections via the marking section cutouts. The layout tool is then shift down the lumber to the next position for marking. The process is repeated until the length of dimensioned lumber is marked. The dimensioned lumber can then be arranged as headers and footers. Once secured, the studs can be attached thereto using the markings made using the layout tool. This greatly increases the expediency in framing a structure and reduces or prevents human error.

It is an object of the present invention to provide a layout tool that can facilitate the marking of multiple items at once.

It is an object of the present invention to provide a layout tool that enables proper spatial measurements for studded framing.

It is an object of the present invention to provide a layout tool that saves time and money connected with marking building materials.

It is another object of the present invention to provide a layout tool that reduces or limits worker error.

It is another object of the present invention to provide a layout tool that is durable and lightweight.

It is another object of the present invention to provide a layout tool that is inexpensive.

It is yet another object of the present invention to provide a layout tool that can mark multiple measurement points.

It is yet another object of the present invention to provide a layout tool that is angled and sized to accommodate standard building materials.

DESCRIPTION OF THE PREFERRED EMBODIMENTS

Figure 1:
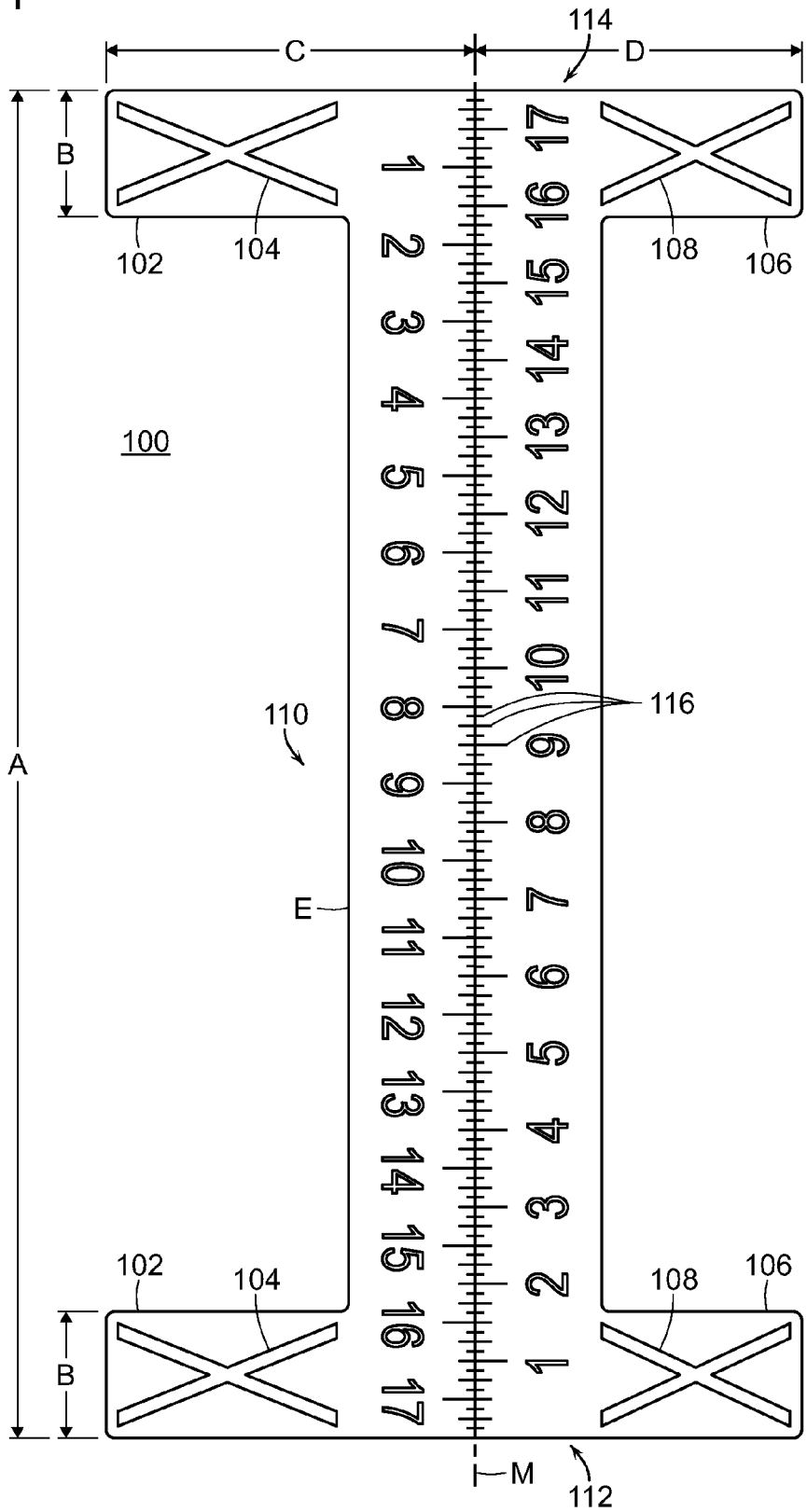
FIG. 1 is a top view of an embodiment of the present invention.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Referring now to FIG. 1, there is a plan view of the layout tool 100 demonstrating the positions of the elements in relation to one another. The layout tool 100 generally comprises a bar body 110, a first end 112, a second end 114, first marking sections 102 with first marking cutouts 104, second marking sections 106 with second marking cutouts 108, and a plurality of markings 116 along the bar body 110.

Figure 2:
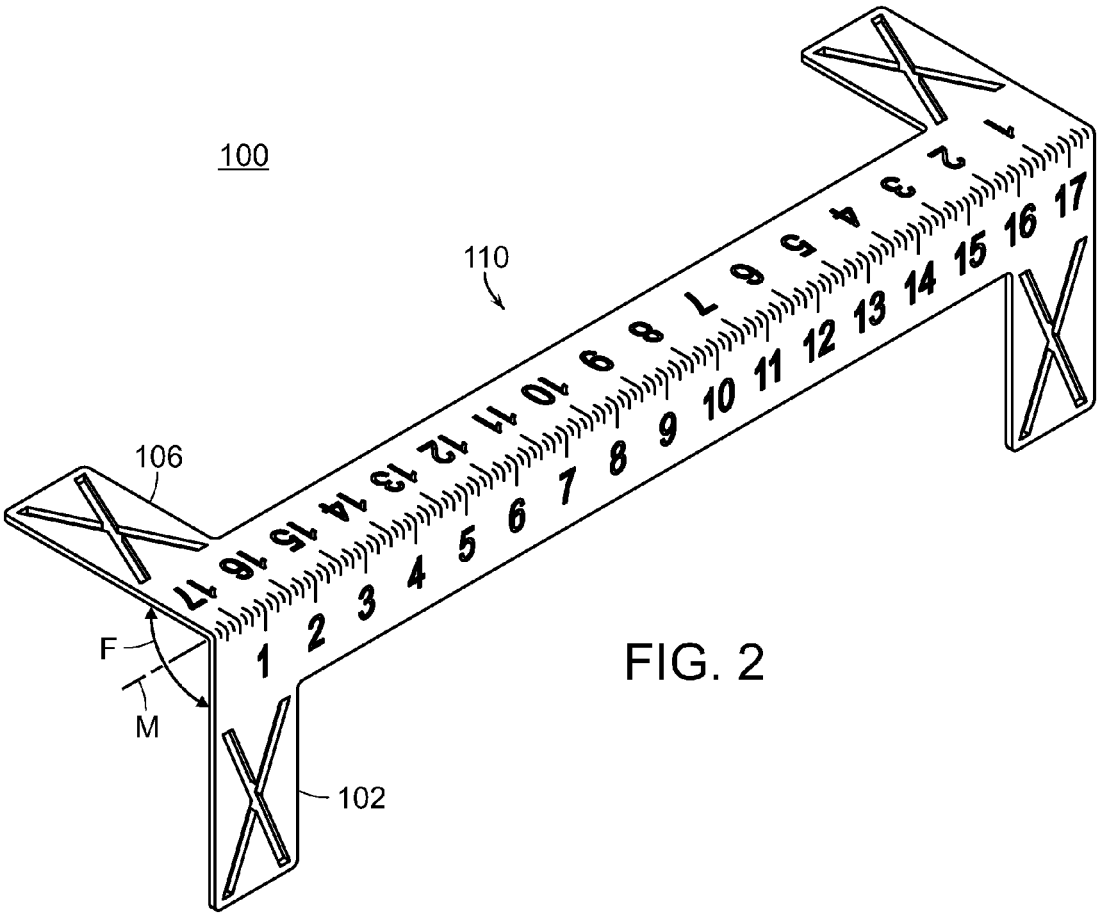
FIG. 2 is a perspective side view of an embodiment of the present invention.
Figure 3:
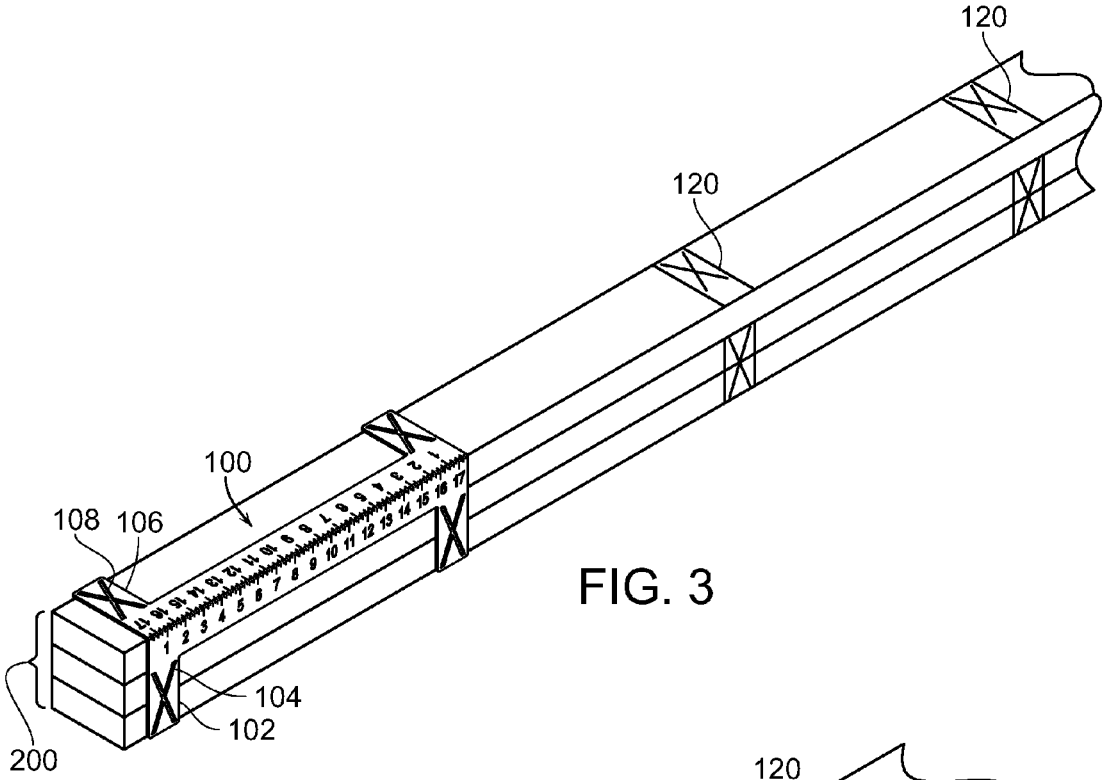
FIG. 3 shows an embodiment of the present invention positioned over a length of material for marking.

The layout tool 100 is approximately 17.5 inches in length as shown by distance A. The bar body 110 forms the general length of the layout tool 100 and is defined by a first end 112 and a second end 114. The first marking sections 102 and the second markings sections 106 extend substantially perpendicularly from the bar body 110. The bar body 110 has a midline M running the length of the bar body, where the bar body 110 is bent or angled about the midline M as shown in FIG. 2. The bar body 110 is preferably bent at about a 90° angle allowing it to be laid over a length of dimensioned lumber 200 as shown in FIG. 3.

On each side of the midline M is a set of marking sections disposed on each of the first end 112 and the second end 114 of the bar body 110. The first marking sections 102 are disposed on a first end 112 and a second end 114 of the bar body 110. The second marking sections 106 are disposed on a first end 112 and a second end 114 of the bar body 110 on the opposing side of the midline M from the first marking sections 102.

Each of the first marking sections 102 and the second marking sections 106 have first marking cutouts 104 and second marking cutouts 108 respectively. The marking cutouts can be virtually any shape but are preferably in the form of an "x." The center of the marking cutout should be positioned to be about 15.25 inches center to center on one side of the bar body 110.

The first marking sections 102 have a width B that is approximately 1.5 inches and a length C as measured from the midline M of the bar body 110. The length C is about 4.5 inches. The second marking section 106 has a width B which is equal to that of the first marking section 102. The length D, however, is about 3.5 inches which is shorter than that of the first marking section 102. These differences in lengths are to accommodate the dimensioned lumber as shown in FIG. 3.

A plurality of markings 116 span the length of the bar body 110. The markings preferably are spaced equidistant between one another and record distances of about 0 to about 17.5 inches. The number of markings and division of the distance may vary and could be shown in 1/32, 1/16, 1/8, 1/4, or 1/2 inch increments. Other increments and units of measure including metric units may be displayed. In some instances, the plurality of markings start at 0 on the first end 112 and end at 17.5 on the second end 114 on one side of the bar body. On the opposite side (of the midline M) of the bar body 110 the markings 116 may begin with 0 at the second end 114 and end at 17.5 on the first end 112.

From the midline M to an edge E the distance is about 1.5 inches which provides for additional flexibility in using the layout tool 100. For example, when laid upon a piece of dimensioned lumber the 1.5 inch mark can be laterally marked to the piece of dimensioned lumber for marking and positioning of a box beam.

In some instances, the layout tool 100 may be a number of different sizes to provide for framing of structures that has studs placed on centers other than 16 inches. For example, other common centering of studs may occur on 12 inch, 19 3/8 inch, and 24 inch centers. In at least one embodiment, the bar body 110 may be able to collapse or expand thereby changing the overall length of the layout tool 100. This may be achieved with a thumb screw or tightening mechanism to secure the position or length of the layout tool 100 and two slidable pieces that are slidably engaged to one another. There may be numerous other iterations that accomplish the same goal and are covered by the scope of this invention and its embodiments.

The layout tool 100 may comprise a number of materials including but not limited to metals, rubbers, plastics, composites, glass, wood, and the like or any combination thereof. Preferably, the layout tool 100 comprises a durable, lightweight plastic. Suitable plastics may include but are not limited to polyethylene terephthalate (PET), polyethylene (PE), high-density polyethylene, polyvinyl chloride (PVC), polyvinylidene chloride (PVDC), low-density polyethylene (LDPE), polypropylene (PP), polystyrene (PS), high impact polystyrene (HIPS) and polycarbonate (PC), or any combination thereof. However, as noted other materials and combinations of materials may be used for all or some of the features of the layout tool 100.

Referring now to FIG. 2 there is a perspective view of the layout tool 100 showing the spatial relationships of the layout tool 100 as a whole. The layout tool 100 is generally shown and defined by the bar body 110, first marking sections 102, and second marking sections 106.

The bar body 110 is bent along the midline M that runs lengthwise down the bar body 110. The midline M is preferably the middle of the bar body 110 discounting the first marking sections 102 and second marking sections 106 extending therefrom. The bend in the bar body 110 forms an angle F which is preferably between about 75° to about 100° and is preferably about 90°. In some instances, it may be preferential for the bar body 110 to flex to adjust to different angles. In other embodiments there may be a hinge or comparable structure that allows for manipulation of the bar body 110 for storage purposes and flexibility in usage.

The angle F formed by the bar body 110 allows the layout tool 100 to lay flat across multiple pieces of dimensioned lumber. This enables the multiple pieces of dimensioned lumber to be marked at once and in a number of differing fashions.

Figure 4:
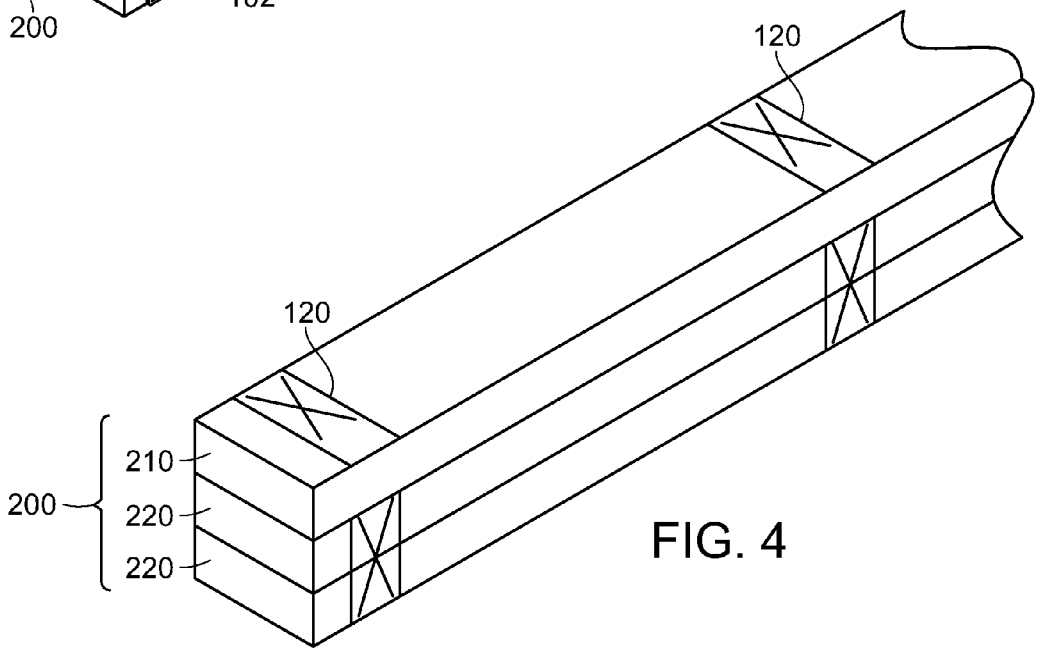
FIG. 4 is a view of the length of material that has been marked using the present invention.
Figure 5:
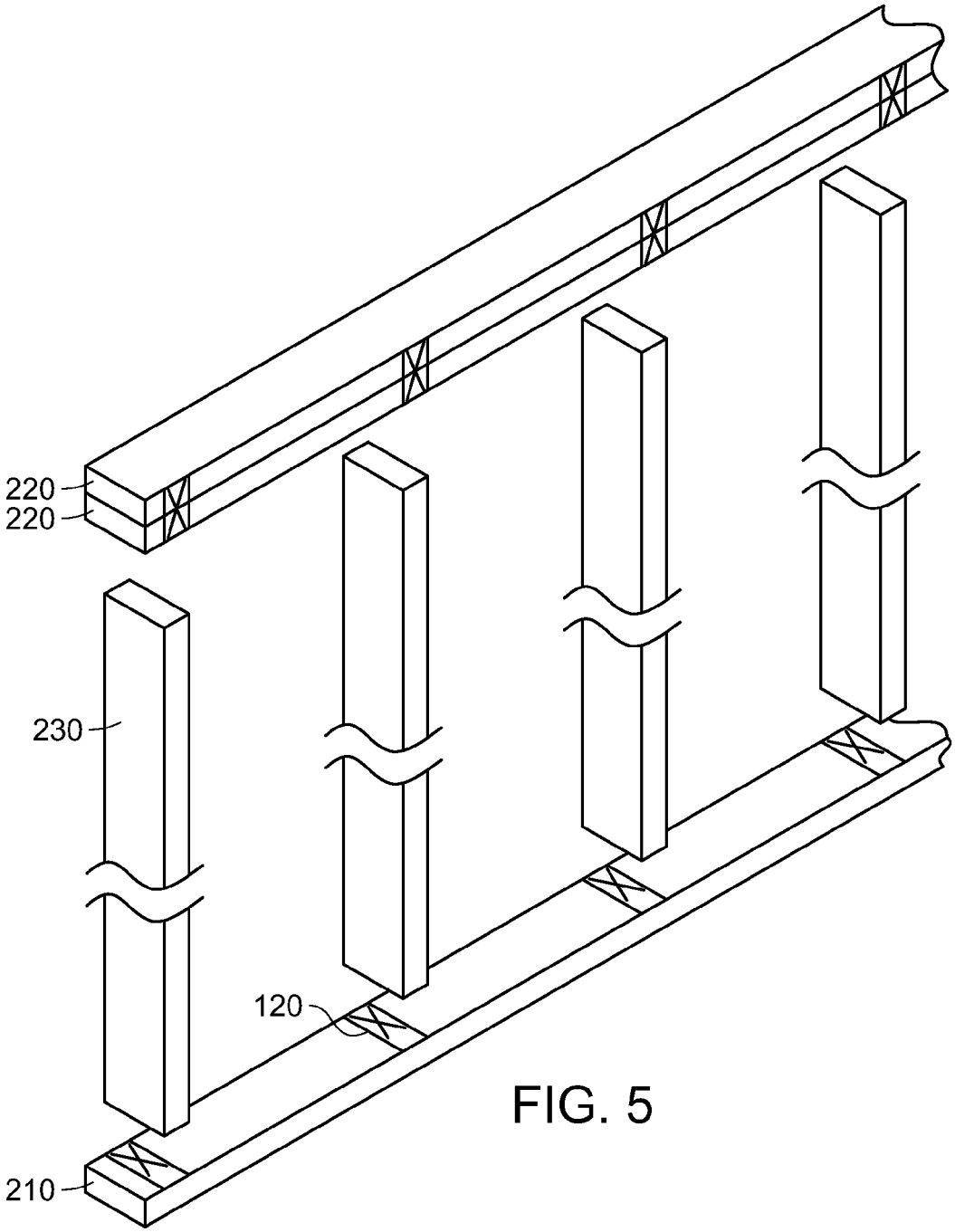
FIG. 5 is a view demonstrating how the present invention and its embodiments can be used to expedite the marking process in the construction of structures.

Referring to FIGS. 3-5, there are representations that show the layout tool 100 in at least one of the intended use scenarios along with the end result. In FIG. 3, the layout tool 100 is shown positioned over three pieces of dimensioned lumber 200. The second marking sections 106 reside on one face of the individual pieces of dimensioned lumber 200. The first marking sections 102 are positioned on a second face of the same piece of dimensioned lumber 200 in addition to the faces of two additional pieces. Each of the faces is marked via the first marking cutouts 104 or the second marking cutouts 108. The markings 120 represent the alignment of lumber as shown in FIG. 5. The layout tool 100 is then shifted to a new position along the length of the dimensioned lumber 200 where the process is repeated. This shift occurs based on the position of the initial marking(s) made.

In FIGS. 4-5, the dimensioned lumber 200 has been marked by the layout tool 100. Typically, the markings 120 cover a footer 210 and one or two headers 220. The markings 120 are aligned in a way that enables the wall to be framed correctly. As shown the header 220 is placed along the top of the frame and the footer 210 along the bottom of the frame. In the event that two headers 220 are used, the headers 220 are stacked upon one another.

The studs 230 are positioned on the markings 120 and aligned with the markings present on each of the footer 210 and the header(s) 220. The studs 230 can then be secured to the header 220 and footer 210 at the proper places forming a wall. The remaining walls can be framed as needed and then covered with the appropriate covering such as sheet rock, gypsum, and the like.

As noted a number of other methodologies made be employed to provide for marking lengths of dimensioned lumber not expressly shown or described in FIGS. 3-5. For example, the position for a box beam can be ascertained by using the about 1.5 inch distance from the midline M of the layout tool 100 to the edge E. The width of the first marking sections 102 or the second marking sections 106, which is also about 1.5 inches, can be used to mark and ascertain the position of the ceiling beams and rafters. Thus, the layout tool 100 is extremely flexible in providing a number of carefully dimensioned surfaces that can be used in conjunction with one another to provide for a complete marking system.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A layout tool for measuring and marking a dimensioned length of material, the layout tool comprising:

at least two first marking sections, wherein each of the at least two first marking sections has at least one first marking cutout;

at least two second marking sections, wherein each of the at least two second marking sections has at least one second marking cutout;

a bar body having a first end and a second end which couples the at least two first marking sections and the at least two second marking sections, wherein one of the at least two first marking sections and one of the at least two second marking sections are positioned near the first end, and wherein one of the at least two first marking sections and one of the at least two second marking sections are positioned near the second end of the bar body.

2. The layout tool of claim 1 further comprising a plurality of markings along a length of the bar body.

3. The layout tool of claim 1 wherein the bar body is angled down the midline of the bar body.

4. The layout tool of claim 3 wherein the angle formed by the bar body is about 90°.

5. The layout tool of claim 1 wherein the at least one first cutout and at least one second cutout are x-shaped.

6. The layout tool of claim 1 wherein the bar body is about 17.5 inches in length.

7. The layout tool of claim 1 wherein a distance from a center point of one of the at least two first marking sections to a center point of another of the at least two first marking sections is about 15.25 inches.

8. The layout tool of claim 1 wherein a distance from a center point of one of the at least two second marking sections to a center point of another of the at least two second marking sections is about 15.25 inches.

9. The layout tool of claim 1 wherein a width of the first marking sections and a width of the second marking sections is about 1.5 inches.

10. A layout tool comprising:

at least two first marking sections, wherein each of the at least two first marking sections has at least one first marking cutout;

at least two second marking sections, wherein each of the at least two second marking sections has at least one second marking cutout;

an angled bar body having a first end and a second end which couples the at least two first marking sections and the at least two second marking sections, wherein one of the at least two first marking sections and one of the at least two second marking sections are positioned on the first end, and wherein one of the at least two first marking sections and one of the at least two second marking sections are positioned on the second end of the bar body; and a plurality of markings along a length of the bar body.

11. The layout tool of claim 10 wherein a width of the first marking section and the second marking section are identical.

12. The layout tool of claim 10 wherein the at least one first marking cutout and the at least one second marking cutout is an x-shape.

13. The layout tool of claim 10 wherein at the plurality of markings are spaced about 0.125 inch away from one another.

14. The layout tool of claim 10 wherein the at least two first marking sections are about 4.5 inches in length.

15. The layout tool of claim 10 wherein the at least two second marking sections are about 3.5 inches in length.

16. A layout tool comprising:

two first marking sections, wherein each of the two first marking sections has one first marking cutout;

two second marking sections, wherein each of the two second marking sections has one second marking cutout;

an angled bar body having a first end and a second end which couples the two first marking sections and the two second marking sections, wherein one of the two first marking sections and one of the two second marking sections are positioned on the first end, and wherein one of the two first marking sections and one of the two second marking sections are positioned on the second end of the bar body; and a plurality of markings along a length of the bar body, the plurality of markings being spaced equidistant from one another.

17. The layout tool of claim 16 wherein the plurality of marking denote increase in value from the first end to the second end of the layout tool on one side of the midline and on the other side of the midline denote an increase from the second end to the first end of the layout tool.

* * * * *